United States Patent [19]

Chénel

[11] Patent Number: 4,468,900

[45] Date of Patent: Sep. 4, 1984

[54] FALSE CEILING ELEMENT

[76] Inventor: Guy G. Chénel, 80, avenue Victor Hugo, Vanves (Hauts de Seine), France

[21] Appl. No.: 318,708

[22] Filed: Nov. 6, 1981

[30] Foreign Application Priority Data

Jun. 17, 1981 [FR] France ..... 81 11968

[51] Int. Cl.[3] ..... E04F 13/00; E04B 5/52; A47H 5/032

[52] U.S. Cl. ..... 52/64; 52/71; 160/84 R

[58] Field of Search ..... 52/64, 63, 71; 160/84 R, 183, 32, 35, 39

[56] References Cited

U.S. PATENT DOCUMENTS

| | | | |
|---|---|---|---|
| 1,950,316 | 3/1934 | Lorenz | 160/84 R |
| 2,635,685 | 4/1953 | Liebhaber | 160/84 R |
| 3,315,727 | 4/1967 | Clark | 160/84 R |
| 3,369,589 | 2/1968 | Benkert, Jr. | 160/84 R |

FOREIGN PATENT DOCUMENTS

| | | | |
|---|---|---|---|
| 249967 | 3/1964 | Australia | 160/84 R |
| 2928135 | 11/1980 | Fed. Rep. of Germany | 52/39 |
| 1066685 | 5/1956 | France | 160/35 |
| 1233680 | 10/1960 | France | 160/84 R |
| 204800 | 8/1939 | Switzerland | 160/84 R |

*Primary Examiner*—John E. Murtagh
*Assistant Examiner*—Michael Safavi
*Attorney, Agent, or Firm*—Seidel, Gonda & Goldhammer

[57] ABSTRACT

This invention concerns a false ceiling element consisting of a strip of thin flexible material, folded generally in a zig-zag manner transversely to its length and hung from at least one support for longitudinal sliding thereon, characterized in that the surfaces of the folds of this strip are connected to one another by at least one flexible element.

3 Claims, 2 Drawing Figures

FALSE CEILING ELEMENT

The invention concerns false ceiling elements, as well as false ceilings such as exhibition halls and stands formed with the aid of these elements.

False ceiling elements are already known which comprise a strip of flexible material of paper, fabric, plastics material, etc., which is folded in zig-zags transversely to its length and which is slidably suspended on one or two horizontal supports, or rods, or wires.

Thus, by assembling several of these strips on horizontal supports in an exhibition hall and by opening out these strips, there are formed, in a rapid and simple manner, false ceilings or suspended ceilings, especially in premises which are to house temporary events, such as exhibitions. These false ceilings are to limit the apparent height of the premises, to provide rational decoration and lighting, to permit heating and air conditioning equipment to handle the whole volume of air in the premises, and also to permit safety devices, such as smoke detectors and sprinklers that discharge water in the case of fire, to function correctly.

However, the known false ceiling elements require lengthy and delicate assembly.

In fact, the advantages of these false ceilings are only obtained if the folds of the strips are evenly distributed on the supports, so that during the erection of a false ceiling, it is necessary for the workman to move the folds with the aid of poles in order to even out their spacing.

Furthermore, with these false ceilings, when a draft is created, the folds of the strips can become flung to one end of the supports, or at least sufficiently displaced on these supports for the unevenness of the folds to nullify completely the usefulness of these false ceilings, especially from a decorative point of view.

A particular object of the present invention is to alleviate these disadvantages and for this purpose concerns a false ceiling element consisting of a strip of this flexible material folded generally in zig-zags transverse to its length and hung from at least one support for longitudinal sliding, the element being characterised in that the surface of the folds of this strip are joined to one another by at least one flexible member.

According to another characteristic of the invention, the flexible member comprises a string or the like passed through the surfaces of the folds of the band and fixed by a spot of adhesive at the level of each of the resulting intersections.

The invention is shown, by way of non limiting example, in the attached drawing, in which.

Consequently, an object of the present invention is the provision of false celing elements which can be assembled simply and easily and of which the folds, after assembly, are automatically maintained in position.

In the attached drawings, a false ceiling element is shown which is composed of a strip 1, folded in zig-zags, and of which each surface is provided with two perforations $1_1$, $1_2$ through which are passed parallel supports, 2 and 3 respectively, on which each strip can thus slide. These supports are, for example, formed by wires.

In this example, the zig-zag arrangement of the strip is obtained by regularly-spaced sharp-angled folds, but any other arrangement can be employed, for example, folds in wave form, while their amplitude may vary, for example, alternately.

According to the invention, the adjacent surfaces $1_3$, $1_4$, $1_5$, $1_6$ etc. of successive folds of the strip 1 are connected to one another by flexible elements $4_1$, $4_2$, $4_3$ etc. in such a way that at the time of erection of the false ceiling element it is possible to open out the folds to a predetermined angle simply by pulling the strip by one of its ends to make it slide along the rods 2 and 3.

Preferably, these flexible members for connecting the surfaces are of the same length but any other arrangement may equally well be employed if it is desired to obtain a particular decorative effect by a successively-varied opening of the folds of the strips.

Figure 1:
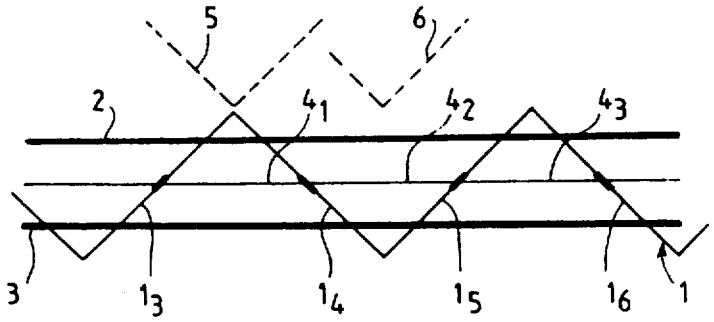
FIG. 1 is a schematic view from above of a false ceiling element.
Figure 2:
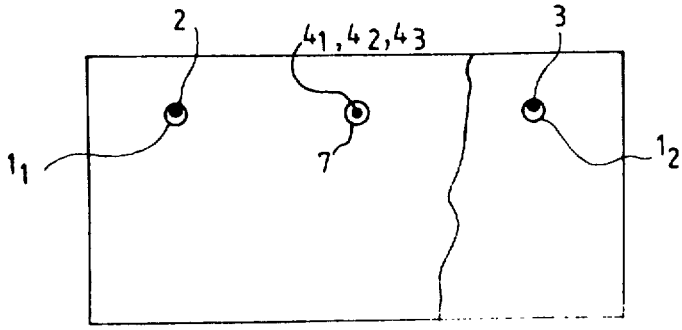
FIG. 2 is a view from the left of FIG. 1.

In the example shown in FIG. 1, surfaces $1_3$, $1_4$, $1_5$, $1_6$ of the folds of the strip 1 are identical surfaces and the flexible connecting members $4_1$, $4_2$, $4_3$ are also of identical length. This length of the members $4_1$, $4_2$, $4_3$ is determined in such a manner that the angles formed by the surfaces $1_3$, $1_4$, $1_5$, $1_6$, etc. have a value of 90° so as to form with the neighboring strips 1 a false ceiling consisting of an arrangement in squares in that the folds of alternate parallel strips of this false ceiling are of opposite phase.

In FIG. 1, such a strip of opposite phase is shown at 5, but any other arrangement can be provided and for example in the case where the assembly of strips has folds arranged in phase (as shown at 6 in FIG. 1), the arrangement in squares is replaced by a zig-zag arrangement of the spaces separating the successive strips.

Also in this example, the height of the strip is smaller than its width and the connecting members $4_1$, $4_2$, $4_3$ are fixed substantially at the same height as the perforations $1_1$ and $1_2$ and at an equal distance from these perforations $1_1$ and $1_2$.

A single suspension support can, however, be used and , in this case, it will be arranged along the central axis of the surfaces of the folds, close to its upper edge, the connecting members being equally disposed in this case close to the support so as to facilitate opening of the folds without the risk of tearing the strip when tractional force is applied to it by one of its ends.

This latter case, which makes use of a single suspension support, will mainly be used when the height of the strip is greater than its width so as to ensure the vertical stability of the strip as by virtue of its own weight.

The connecting members $4_1$, $4_2$, $4_3$ will preferably be formed using string, wire or ribbon passed through the assembly of the surfaces of the folds of the strip 1 and fixed at regular intervals on the surfaces of these folds by spots of adhesive 7, so as to obtain a robust assembly, without excess thickness of the main surface, which can provide a shaded area by reason of the lighting of the hall. This fixing by points of adhesive could equally well be replaced by staples or any other means and for example this fixing may be obtained by lodging the string in notches or slits formed in the strip.

This string which extends over the whole length of the strip can be hooked by one of its ends to a fixed point so that by pulling on the other end the spacing of the folds can automatically be controlled.

This embodiment permits the formation of a connection resistant to traction over a great length at the time of erection of the strip and the avoidance to the maximum extent of the deformation of the folds resulting from a softening of the material of the strip, caused, for example, by an increase in the humidity of the ambient air.

It will be noted besides that the presence of this connection between the faces of the folds does not preclude the possibility of storing the strip in the folded state for transportation.

I claim:

1. A false ceiling element comprising a strip of thin flexible material folded generally in a zig-zag manner transversely to its length and hung from at least one support for longitudinal sliding thereon, said element being characterized in that the adjacent surfaces of the strip are connected to one another by at least one flexible member extending generally parallel to said support, said flexible member comprising a string passing through the surfaces of the folds of the strip and said string is fixed at the level of each of the resulting intersections by a spot of adhesive.

2. A false ceiling element in accordance with claim 1 wherein the strip is made of paper.

3. A false ceiling element in accordance with claim 1 wherein the flexible member extends generally parallel to the support when the folds are open.

* * * * *